US011438975B2

(12) United States Patent
Acero Acero et al.

(10) Patent No.: US 11,438,975 B2
(45) Date of Patent: Sep. 6, 2022

(54) COOKING APPLIANCE

(71) Applicant: BSH Hausgeräte GmbH, Munich (DE)

(72) Inventors: Jesus Acero Acero, Saragossa (ES); Claudio Carretero Chamarro, Saragossa (ES); Jose Maria De la Cuerda Ortin, Saragossa (ES); Juan Jose Galindo Perez, Saragossa (ES); Pablo Jesus Hernandez Blasco, Saragossa (ES); Izaskun Jaca Equiza, Saragossa (ES); Ignacio Lope Moratilla, Saragossa (ES)

(73) Assignee: BSH Hausgeräte GmbH, Munich (DE)

( * ) Notice: Subject to any disclaimer, the term of this patent is extended or adjusted under 35 U.S.C. 154(b) by 543 days.

(21) Appl. No.: 16/466,048

(22) PCT Filed: Dec. 12, 2017

(86) PCT No.: PCT/IB2017/057832
§ 371 (c)(1),
(2) Date: Jun. 3, 2019

(87) PCT Pub. No.: WO2018/116065
PCT Pub. Date: Jun. 28, 2018

(65) Prior Publication Data

US 2020/0068669 A1 Feb. 27, 2020

(30) Foreign Application Priority Data

Dec. 23, 2016 (ES) ..... ES201631669

(51) Int. Cl.
*H05B 6/36* (2006.01)
*H05B 6/12* (2006.01)
(Continued)

(52) U.S. Cl.
CPC ..... *H05B 6/365* (2013.01); *H05B 6/129* (2013.01); *H05B 6/362* (2013.01); *H05B 6/40* (2013.01); *H05B 11/00* (2013.01); *F24C 7/00* (2013.01)

(58) Field of Classification Search
CPC ..... F24C 7/00; H05B 11/00; H05B 6/129; H05B 6/362; H05B 6/365; H05B 6/40
(Continued)

(56) References Cited

U.S. PATENT DOCUMENTS 3,790,735 A 2/1974 Peters
6,147,336 A * 11/2000 Ushijima ..... H05B 6/129 219/601
(Continued)

FOREIGN PATENT DOCUMENTS

DE 19852617 A1 1/2000
JP H05187640 A 7/1993
WO 2012056957 A1 5/2012

OTHER PUBLICATIONS

Translation of JPH05187640A, High Frequency Heating Device, Jul. 27, 1993, by ProQuest (Year: 1993).*
(Continued)

*Primary Examiner* — Quang T Van
(74) *Attorney, Agent, or Firm* — Michael E. Tschupp; Andre Pallapies; Brandon G. Braun

(57) ABSTRACT

A cooking appliance, in particular an induction oven appliance, includes a cavity having a wall, at least one induction heating element, and at least one electrically conductive screening element for screening an electric and/or magnetic field generated by the induction heating element. The induction heating element can be arranged on the wall of the cavity.

22 Claims, 3 Drawing Sheets

(51) Int. Cl.

| | |
|---|---|
| ***H05B 6/40*** | (2006.01) |
| ***H05B 11/00*** | (2006.01) |
| *F24C 7/00* | (2006.01) |

(58) Field of Classification Search
USPC ..... 219/601, 620, 622, 624, 629, 632, 670, 219/671, 675, 679, 680, 738, 756, 398; 99/451, DIG. 14
See application file for complete search history.

(56) References Cited

U.S. PATENT DOCUMENTS

| | | | | |
|---|---|---|---|---|
| 2004/0144773 | A1* | 7/2004 | Kim ..... | H05B 6/6488 219/601 |
| 2010/0059513 | A1 | 3/2010 | Farachi et al. | |

OTHER PUBLICATIONS

Translation of QO2012056957A1, Induction Heating Device and Heating System Equipped with same, May 3, 2012, by ProQuest. (Year: 2012).*
International Search Report PCT/IB2017/057832 dated Mar. 13, 2018.

* cited by examiner

COOKING APPLIANCE

CROSS-REFERENCES TO RELATED APPLICATIONS

This application is the U.S. National Stage of International Application No. PCT/IB2017/057832, filed Dec. 12, 2017, which designated the United States and has been published as International Publication No. WO 2018/116065 A1 and which claims the priority of Spanish Patent Application, Serial No. P201631669, Dec. 23, 2016, pursuant to 35 U.S.C. 119(a)-(d).

BACKGROUND OF THE INVENTION

The invention relates to a cooking appliance.

The patent application US 2010/0059513 A1 already discloses a cooking appliance having an induction heating element that, in an operating condition, heats a wall of the cooking appliance cavity. Arranged on a side of the induction heating element that is remote from the wall of the cavity is a magnetic element that is made largely from ferrites, which are in particular ferromagnetic ceramic materials. The magnetic element has low electrical conductivity and low thermal conductivity.

BRIEF SUMMARY OF THE INVENTION

The object of the invention is in particular to provide a generic appliance having improved properties in respect of efficiency. The object is achieved according to the invention by the features of claim 1, while advantageous embodiments and developments of the invention can be found in the subclaims.

The invention takes as its starting point a cooking appliance, in particular an induction oven appliance, having at least one wall of a cavity and at least one induction heating element.

It is proposed that the cooking appliance should have at least one electrically conductive screening element that is provided for the purpose of screening an electrical and/or magnetic field that is generated by the induction heating element.

The term "cooking appliance", in particular the term "induction cooking appliance" and advantageously the term "induction oven appliance", should in particular be understood to mean at least a part, in particular a subassembly, of a cooker, in particular an induction cooker and advantageously an induction oven. For example, a cooker having the cooking appliance could take the form of a grill and/or a steam cooker and/or a microwave device.

The term "induction cooker", in particular the term "induction oven", should in particular be understood to mean a cooker, in particular an oven, that has at least one inductive operating condition and could in particular, in addition to the inductive operating condition, have at least one operating condition that differs from inductive heating, such as at least one resistance-heated operating condition.

The cooking appliance has in particular at least one cavity. The wall of the cavity is in particular part of the cavity. The cavity has in particular at least one cavity rear wall and/or at least one cavity side wall, advantageously at least two cavity side walls, and/or at least one cavity top wall and/or at least one cavity bottom wall.

The wall of the cavity could for example be a cavity rear wall and/or at least one cavity side wall and/or at least one cavity top wall and/or at least one cavity bottom wall. The cavity at least substantially delimits a cooking compartment, in particular at least in part, and advantageously in at least one operating condition together with at least one appliance door of the cooking appliance. The cooking appliance has in particular at least one appliance door that at least in part delimits the cooking compartment in at least one operating condition. The cooking compartment is provided in particular for introducing cooking material such as food for the purpose of heating and/or warming the food and/or keeping the food warm. In particular, the wall of the cavity is a wall that delimits the cooking compartment, at least on one side.

The cooking appliance has in particular at least one cooker rear wall. The cooker rear wall is in particular at least substantially and advantageously entirely arranged within the cooking compartment. The cooker rear wall is in particular arranged in a region close to at least one wall of the cavity that takes the form of a cavity rear wall.

In particular, the induction heating element is provided for the purpose of generating an alternating electromagnetic field, in particular having a frequency of between 17 kHz and 150 kHz. The induction heating element is in particular provided for the purpose of generating heat in at least one in particular metal, preferably ferromagnetic, object for heating, by means of the alternating electromagnetic field generated by the induction heating element, by eddy current induction and/or magnetization reversal effects, in particular by converting the alternating electromagnetic field into heat in the object for heating. The object for heating could for example be a cooking dish in and/or introduced into the cooking compartment. As an alternative or in addition, the object for heating could for example be at least the wall of the cavity. The induction heating element is in particular wound into an in particular flat coil and has in particular at least three, advantageously at least five, particularly advantageously at least eight, preferably at least twelve and particularly preferably a multiplicity of windings.

The screening element has in particular an electrical conductivity of at least $10^3$ S/m, in particular at least $10^4$ S/m, advantageously at least $10^5$ S/m, particularly advantageously at least $10^6$ S/m and preferably at least $10^7$ S/m at 20° C. The screening element has in particular a specific electrical resistance of at most $10^2$ $\Omega mm^2/m$, in particular at most $10^1$ $\Omega mm^2/m$, advantageously at most $10^0$ $\Omega mm^2/m$ and particularly advantageously at most $10^{-1}$ $\Omega mm^2/m$ at 20° C. The screening element has in particular a melting point of at least 300° C., in particular at least 350° C., advantageously at least 400° C., particularly advantageously at least 500° C. and preferably at least 600° C., and for this reason the screening element has in particular a high resistance to heat.

In particular, the screening element and the wall of the cavity take mutually different forms and are in particular movable in relation to one another in at least one disassembled condition. In particular, the screening element differs from the wall of the cavity.

The screening element could for example be provided for the purpose of screening an electrical field generated by the induction heating element and/or for the purpose of screening a magnetic field generated by the induction heating element and/or for the purpose of screening an electromagnetic field generated by the induction heating element. In particular, the electrical and/or magnetic field could be an electrical field and/or a magnetic field and/or an electromagnetic field.

For example, the screening element could take the form of a partition wall and be arranged in particular at least in part between the induction heating element and at least one electronics unit. In particular, the screening element could be provided for the purpose of screening at least one electronics unit, which could for example be part of the cooking appliance or part of at least one cooktop, from the electrical and/or magnetic field generated by the induction heating element. In particular, the screening element could as an alternative or in addition, in particular in the case of a wall of the cavity taking the form of a cavity top wall, be provided for the purpose of screening at least one electronics unit that in an installed condition is arranged above the screening element and could for example be part of a cooktop, in particular an induction cooktop, from the electrical and/or magnetic field generated by the induction heating element. As an alternative or in addition, the screening element could for example be provided for the purpose of screening at least one surrounding area in particular of the cooker from the electrical and/or magnetic field generated by the induction heating element. The screening element could for example be part of a cooker outer housing of the cooking appliance.

For example, in particular in addition to its function as a screening element, the screening element could form a support element and be provided for the purpose of supporting, in at least one assembled condition, at least one further object, as a result of which in particular additional costs can be avoided. The further object could for example be at least one printed circuit board and/or at least one control unit and/or at least one operating unit and/or at least one light source and/or at least one fan unit and/or at least one sensor unit. In particular, the cooking appliance could have the further object. For example, the further object could be connected to the screening element by means of at least one latching connection and/or at least one screw connection and/or at least one connection made by locking and/or at least one connection made by clipping together, and advantageously be arranged, in particular secured, to the screening element.

The term "provided" should in particular be understood to mean specially constructed and/or equipped. The fact of an object being provided for the purpose of a specific function should in particular be understood to mean that the object fulfills and/or performs this specific function in at least one application condition and/or operating condition.

As a result of the embodiment according to the invention, it is possible in particular to achieve a high level of efficiency, in particular in respect of costs. By comparison with a configuration having at least one magnetic element, in particular ferrites, it is possible in particular to achieve low costs and/or a low overall weight of a cooker having the cooking appliance. In particular, it is possible to achieve a high tolerance to electromagnetic interference (high EMI tolerance), in particular by comparison with a configuration having at least one magnetic element, in particular ferrites. In particular, because the screening element has high resistance to heat, in particular by comparison with a configuration having at least one magnetic element, in particular ferrites, better behavior under heat may be made possible. In particular, a simple assembly method may be made possible, in particular on the basis that the screening element is adaptable in a simple manner. As a result of the screening element, in particular screening of a surrounding area from an electrical and/or magnetic field generated by the induction heating element to within a narrowly delimited overall space may be achieved. In particular, a good cost/benefit ratio may be made possible.

It is further proposed that the induction heating element should be arranged on the wall of the cavity. In particular, the induction heating element could be secured directly and/or indirectly to the wall of the cavity. The induction heating element could for example be connected directly and/or indirectly to the wall of the cavity by at least one mechanical connection and in particular be arranged on the wall of the cavity. As an alternative or in addition, the induction heating element could take the form of at least one coating and in particular be arranged directly and/or indirectly on the wall of the cavity. This may in particular achieve a compact configuration.

The induction heating element could be arranged for example at least substantially and advantageously entirely within the cooking compartment. Advantageously, the induction heating element is arranged at least substantially and advantageously entirely outside the cooking compartment. Preferably, the screening element is arranged at least in part and advantageously entirely on a side of the induction heating element that is remote from the wall of the cavity. In particular, the screening element is arranged at least substantially and advantageously entirely outside the cooking compartment. The expression that an element is arranged "at least in part" on a side of an object remote from another object should in particular be understood to mean that at least one partial region of the element is arranged on the side of the object that is remote from the other object, wherein the element could have at least one further partial region that could be arranged on a different side from the side of the object that is remote from the other object. As a result, it is possible in particular to achieve a high tolerance to electromagnetic interference (high EMI tolerance).

It is further proposed that the screening element should be made at least largely from aluminum and/or an aluminum alloy. In particular, the screening element has an electrical conductivity of at least substantially $3.7*10^7$ S/m at 20° C. In particular, the screening element has a specific electrical resistance of at least substantially $2.65*10^{-2}$ $\Omega mm^2/m$ at 20° C. In particular, the screening element has a melting point of at least substantially 660° C. The term "at least substantially" in this context should in particular be understood to mean that a deviation from a predetermined value is in particular less than 25%, preferably less than 10% and particularly preferably less than 5% of the predetermined value. The term "at least largely" should in particular be understood to mean by a proportion of at least 70%, in particular at least 80%, advantageously at least 90% and preferably at least 95%. As an alternative or in addition, the screening element could be made at least largely from copper and/or non-ferromagnetic steel. This in particular allows a high level of efficiency and/or a high level of functionality to be achieved. In particular, an inexpensive configuration may be made possible.

Further, it is proposed that the cooking appliance should have at least one thermal insulation element that is arranged at least in part and advantageously entirely between the screening element and the induction heating element. The expression that an element is arranged "at least in part" between an object and a further object should in particular be understood to mean that at least a partial region of the element is arranged between the object and the further object, wherein the element could have at least one further partial region that could be arranged outside an intermediate space between the object and the further object. In particular, the thermal insulation element has a thermal conductivity of at most 5 W/(m*K), in particular at most 2 W/(m*K), advantageously at most 1 W/(m*K), particularly advantageously at most 0.1 W/(m*K), by preference at most 0.05 W/(m*K), preferably at most 0.01 W/(m*K) and particularly preferably at most 0.005 W/(m*K) at 0° C. In particular, the thermal insulation element is provided for the purpose of at least substantially preventing a transfer of heat and/or thermal radiation to the screening element in at least one operating condition. In particular, the thermal insulation element is provided for the purpose of preventing a proportion of at least 50%, in particular at least 70%, advantageously at least 75% and preferably at least 80% of any heat and/or thermal radiation that strikes a first side of the thermal insulation element from passing through the thermal insulation element in at least one operating condition. In particular, the thermal insulation element has a thickness of at least 5 mm, in particular at least 15 mm, advantageously at least 30 mm, particularly advantageously at least 40 mm and preferably at least 50 mm. In particular, the thermal insulation element is made at least largely from glass fiber and/or ceramic and/or mineral wool and/or any other mineral or ceramic-based insulation. This enables the screening element in particular to be protected from excessive heating, and/or heating of a surrounding area to be prevented efficiently.

Moreover, it is proposed that the thermal insulation element should directly adjoin the screening element and/or the induction heating element. The expression that a first object "directly adjoins a second object" should in particular be understood to mean that the first object and the second object are arranged in direct contact with one another and in particular, at least in certain regions, touch one another and/or that an intermediate space between the first object and the second object is free of further objects. In particular, an intermediate space between the screening element and the induction heating element is free of magnetic elements, in particular ferrites. A side of the wall of the cavity that is remote from the induction heating element is in particular free of magnetic elements, in particular ferrites. For example, the thermal insulation element could be arranged in direct contact with the induction heating element. The thermal insulation element could for example be spaced from the screening element by at least one air-filled intermediate space. The air-filled intermediate space could have a thickness for example of at least 5 mm, in particular at least 10 mm, advantageously at least 15 mm, particularly advantageously at least 20 mm and preferably at least 25 mm. This means in particular that a particularly compact configuration can be achieved. In particular, magnetic elements, in particular ferrites, can be dispensed with, as a result of which in particular low costs and/or a low overall weight of a cooker having the cooking appliance may be made possible.

The induction heating element could for example be arranged directly on the wall of the cavity, wherein in particular an intermediate space between the induction heating element and the wall of the cavity could be free of further objects. Preferably, the cooking appliance has at least one electrical insulation element that is arranged at least in part between the induction heating element and the wall of the cavity. The electrical insulation element has in particular an electrical conductivity of at most $1*10^{2}$ S/m, in particular at most $1*10^{0}$ S/m, advantageously at most $1*10^{-2}$ S/m, particularly advantageously at most $1*10^{-3}$ S/m, by preference at most $1*10^{-4}$ S/m, preferably at most $1*10^{-5}$ S/m and particularly preferably at most $1*10^{-6}$ S/m. In particular, the electrical insulation element is provided for the purpose of at least substantially preventing electrical current from passing from the induction heating element to the wall of the cavity in at least one operating condition. In particular, the electrical insulation element is provided for the purpose of preventing a proportion of at least 50%, in particular at least 70%, advantageously at least 75% and preferably at least 80% of electrical current that strikes a first side of the electrical insulation element from passing through the electrical insulation element in at least one operating condition. The electrical insulation element is in particular made at least largely from at least one electrically insulating material, such as mica and/or polyimide and/or ceramic. This can in particular achieve a high level of safety and/or protect a person operating the appliance from electrocution. In particular, regulations relating to electrical screening can be observed.

Further, it is proposed that the induction heating element should be spaced by at most 3 mm, in particular at most 2 mm, advantageously at most 1 mm, particularly advantageously at most 0.6 mm and preferably at most 0.4 mm from the wall of the cavity, in particular in a direction perpendicular to a main plane of extent of the wall of the cavity. The term "main plane of extent" of an object should in particular be understood to mean a plane that runs parallel to the largest side face of the smallest notional geometric cube that is large enough to envelop the object, in particular running through the center point of the cube. In particular, the electrical insulation element has a thickness of at most 3 mm, in particular at most 2 mm, advantageously at most 1 mm, particularly advantageously at most 0.6 mm and preferably at most 0.4 mm. This in particular enables a compact configuration to be achieved. In particular, highly efficient induction can be achieved. If the induction heating element is spaced from the wall of the cavity by the thermal insulation element, it is possible in particular to achieve efficiency comparable with that of a cooktop.

Moreover, it is proposed that the screening element should be spaced from the wall of the cavity and/or from the induction heating element by at least 20 mm, in particular at least 25 mm, advantageously at least 30 mm, particularly advantageously at least 35 mm and preferably at least 40 mm. The screening element is in particular spaced from the wall of the cavity and/or from the induction heating element by at most 100 mm, in particular at most 80 mm, advantageously at most 70 mm and preferably at most 60 mm. In particular, the screening element is at least five times, in particular at least seven times, advantageously at least eight times, particularly advantageously at least nine times and preferably at least ten times as far away from the wall of the cavity and/or from the induction heating element as the induction heating element is from the wall of the cavity. This in particular enables a sufficiently large intermediate space to be created between the screening element and the wall of the cavity in order in particular to enable further objects to be arranged in the intermediate space and/or in order in particular to enable heating of the screening element to be prevented. In particular, electromagnetic losses in the screening element can be kept low.

For example, the induction heating element could be provided for the purpose of inductive heating of at least one cooking dish that is in and/or introduced into the cooking compartment. Preferably, the induction heating element is provided for the purpose of heating the wall of the cavity inductively, as a result of which in particular particularly efficient heating of food that is in and/or introduced into the cooking compartment, and/or an optimal cooking result, can be achieved.

Further, it is proposed that, in at least one operating condition, the induction heating element should heat up the wall of the cavity to a temperature of at least 300° C., in particular at least 400° C., advantageously at least 500° C. and preferably at least 550° C., as a result of which in particular a multiplicity of different operating modes and/or cooking programs can be made possible. In particular, high operating temperatures can be achieved.

A particularly high level of efficiency may in particular be achieved by a cooker, in particular by an induction cooker and advantageously by an induction oven, having at least one cooking appliance according to the invention, in particular having at least one induction cooking appliance according to the invention and advantageously having at least one induction oven appliance according to the invention.

Further, it is proposed that the cooker, in particular the induction cooker and the induction oven, should be free of ferrites provided for the purpose of conducting a magnetic field generated by the induction heating element. As a result, in particular low costs and/or a low overall weight of the cooker can be achieved.

Here, the cooking appliance is not intended to be restricted to the above-mentioned use and configuration. In particular, for the purpose of fulfilling a function described herein, the cooking appliance may have a different number of individual elements, components and units from the number mentioned herein.

Further advantages become apparent from the description of the drawing below. The drawing illustrates exemplary embodiments of the invention. The drawing, the description and the claims contain numerous features in combination. The person skilled in the art will also favorably consider the features individually and group them together to form useful further combinations.

DETAILED DESCRIPTION OF EXEMPLARY EMBODIMENTS OF THE PRESENT INVENTION

Figure 1:
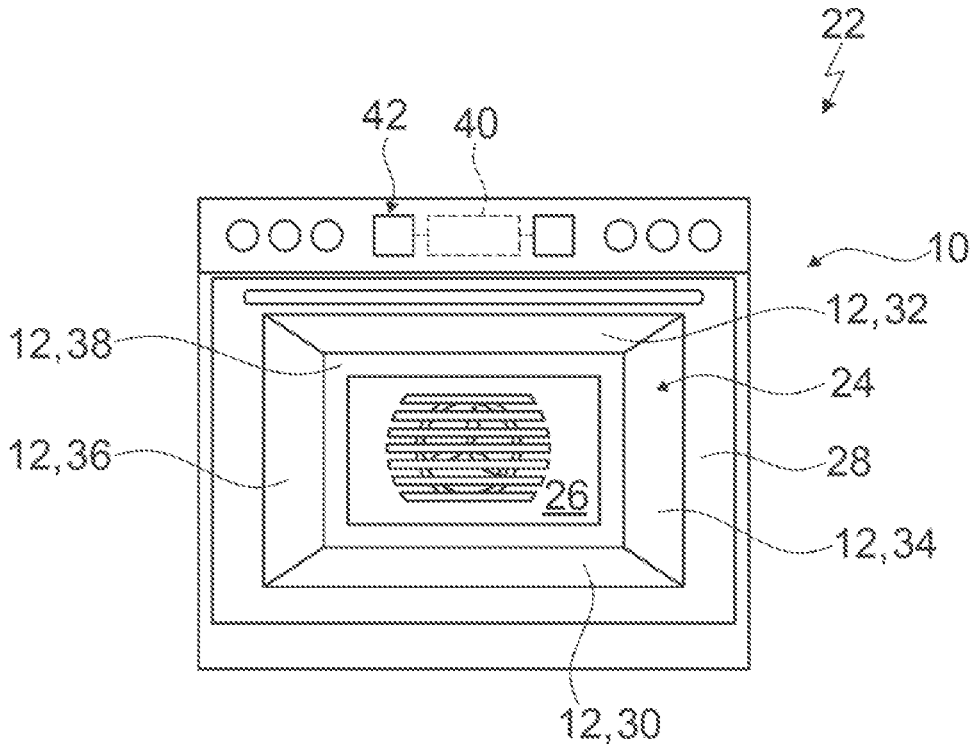
FIG. 1 shows a schematic illustration of a cooker having a cooking appliance.

FIG. 1 shows a cooker 22 that takes the form of an induction cooker, having a cooking appliance 10 that takes the form of an induction cooking appliance. For example, the cooker 22 could take the form of a grill and/or a steam cooker and/or a microwave device. In the present exemplary embodiment, the cooker 22 takes the form of an induction oven. The cooking appliance 10 takes the form of an induction oven appliance.

The cooking appliance 10 has a cavity 24. The cavity 24 partially delimits a cooking compartment 26. The cavity 24 delimits the cooking compartment 26 substantially together with a cooker door 28. The cooking appliance 10 has the cooker door 28.

The cooking appliance 10 has five walls 12 for the cavity. Where a plurality of objects are present, in each case only one is provided with a reference numeral in the figures. The walls 12 of the cavity are part of the cavity 24. Together with the cooker door 28, the walls 12 of the cavity substantially define the cooking compartment 26.

One of the walls 12 of the cavity takes the form of a cavity bottom wall 30. One of the walls 12 of the cavity takes the form of a cavity top wall 32. One of the walls 12 of the cavity takes the form of a cavity rear wall 38. Two of the walls 12 of the cavity take the form of a cavity side wall 34, 36. Only one of the walls 12 of the cavity will be described below.

The cooking appliance 10 has a user interface 42 for the purpose of inputting and/or selecting operating parameters (cf. FIG. 1), for example a heating power and/or a heating power density and/or a heating zone. The user interface 42 is provided for the purpose of outputting a value of an operating parameter to a user.

Figure 2:
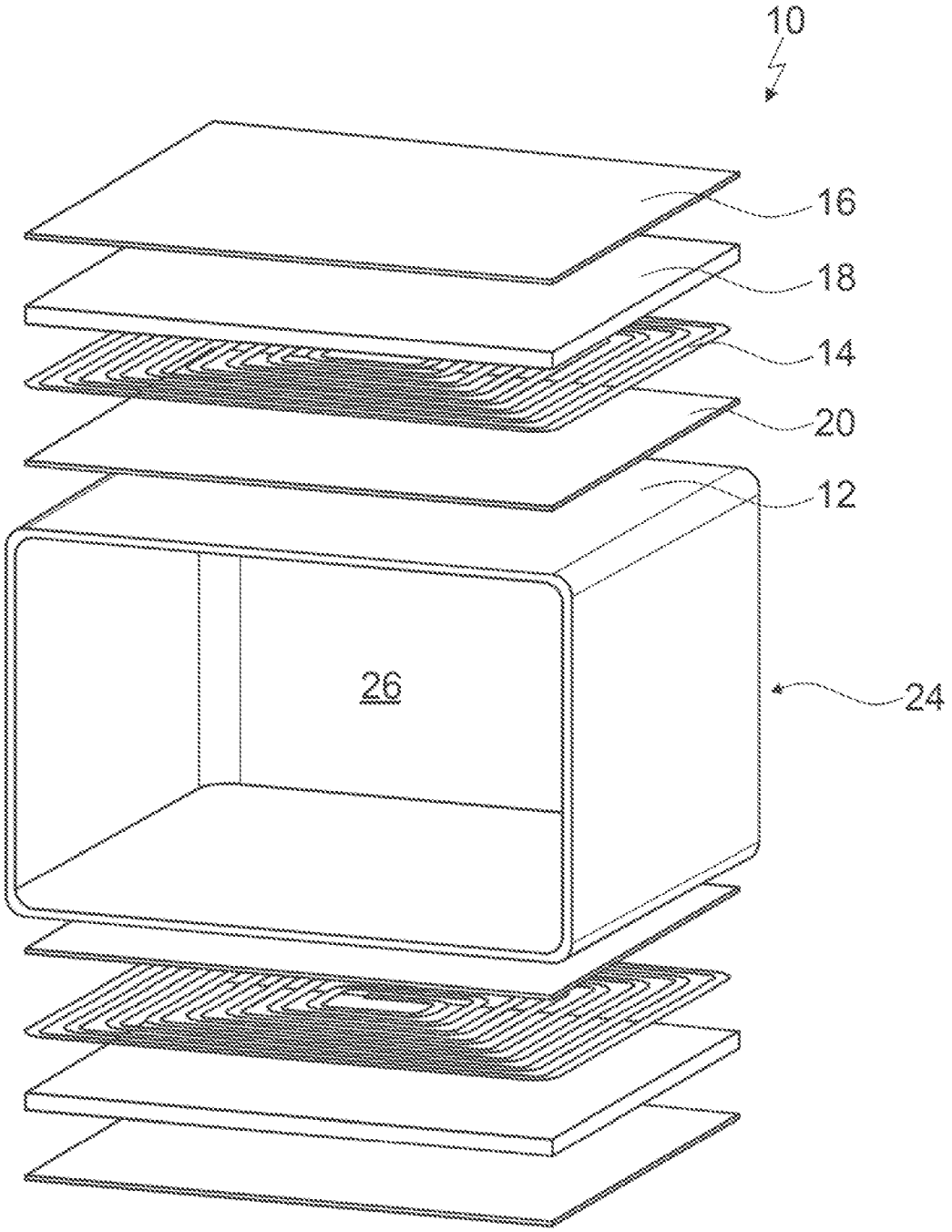
FIG. 2 shows a schematic exploded illustration of a cavity, two electrical insulation elements, two induction heating elements, two thermal insulation elements and two screening elements of the cooking appliance.

The cooking appliance 10 has a control unit 40. The control unit 40 is provided for the purpose of performing actions and/or changing settings, in dependence on operating parameters that are input using the user interface 42. In one operating condition, the control unit 40 controls a supply of energy to at least one induction heating element 14 (cf. FIG. 2).

In the present exemplary embodiment, the cooking appliance 10 has two induction heating elements 14. As an alternative, the cooking appliance 10 could in particular have a different number of induction heating elements 14. For example, the cooking appliance 10 could have precisely one induction heating element 14. As an alternative, the cooking appliance 10 could have for example at least three, in particular at least four, advantageously at least five and preferably a multiplicity of induction heating elements 14.

In one operating condition, the induction heating elements 14 are arranged outside the cooking compartment 26. In an installed position, a lower induction heating element 14 of the induction heating elements 14 is arranged below the wall 12 of the cavity that takes the form of the cavity bottom wall 30. The lower induction heating element 16 is arranged on the wall 12 of the cavity that takes the form of the cavity bottom wall 30.

In an installed position, an upper induction heating element 14 of the induction heating elements 14 is arranged above the wall 12 of the cavity that takes the form of the cavity top wall 32. The upper induction heating element 14 is arranged on the wall 12 of the cavity that takes the form of the cavity top wall 32.

As an alternative, at least one induction heating element 14 could be arranged on a wall 12 of the cavity that takes the form of a side wall 34, 36 and/or on a wall 12 of the cavity that takes the form of the cavity rear wall 38. Only one of the induction heating elements 14 will be described below.

In the present exemplary embodiment, the cooking appliance 10 has two electrically conductive screening elements 16. The number of screening elements 16 and the number of induction heating elements 14 are substantially identical. Only one of the screening elements 16 will be described below.

Figure 3:
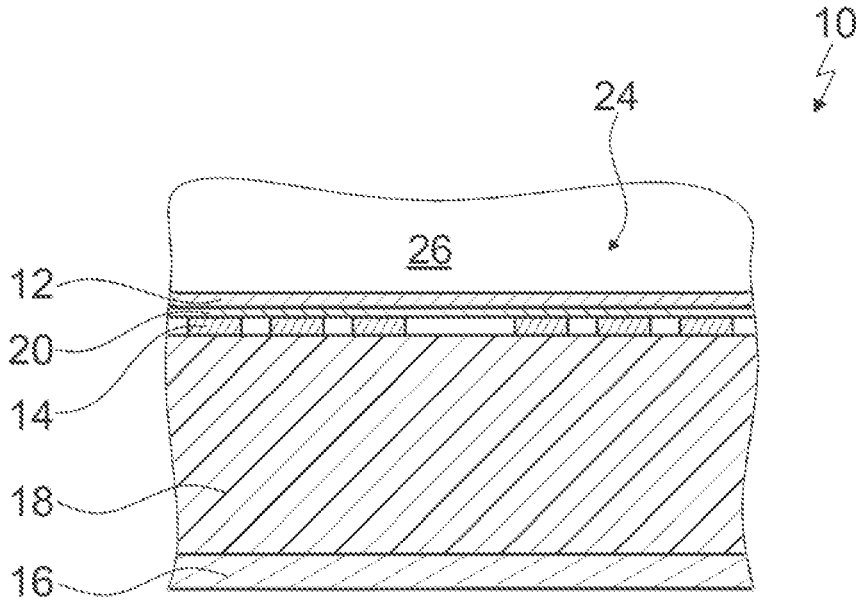
FIG. 3 shows a schematic sectional illustration of an enlarged detail of FIG. 2, in an assembled condition.

Only the region illustrated in FIG. 3—in which, in an installed position, the lower induction heating element 14 is arranged—will be described below. An analogous description may be given for a region in which, in an installed position, the upper induction heating element 14 is arranged.

The screening element 16 is provided for the purpose of screening an electrical and/or magnetic field generated by the induction heating element 14. In an operating condition in which in particular high-frequency alternating current flows through the induction heating element 14, the screening element 16 screens out the electrical and/or magnetic field generated by the induction heating element 14.

In the operating condition, the screening element 16 screens a region that is arranged on a side of the screening element 16 remote from the wall 12 of the cavity from the electrical and/or magnetic field generated by the induction heating element 14. In an assembled condition, the screening element 16 is arranged in part on a side of the induction heating element 14 remote from the wall 12 of the cavity.

In the present exemplary embodiment, the screening element 16 is made largely from aluminum. As an alternative, the screening element 16 could be made largely from an aluminum alloy. The screening element 16 is substantially plate-like in shape.

In the assembled condition, the screening element 16 is arranged spaced from the induction heating element 14. The cooking appliance 10 has a thermal insulation element 18. In the assembled condition, the thermal insulation element 18 is arranged in part between the screening element 16 and the induction heating element 14.

In the installed condition, the thermal insulation element 18 directly adjoins the induction heating element 14. The thermal insulation element 18 directly adjoins the screening element 16 in the installed condition.

An intermediate space between the screening element 16 and the induction heating element 14 is free of ferrites provided for the purpose of conducting a magnetic field generated by the induction heating element 14. The cooking appliance 10 is free of ferrites provided for the purpose of conducting a magnetic field generated by the induction heating element 14. The cooker 22 is free of ferrites provided for the purpose of conducting a magnetic field generated by the induction heating element 14. In the assembled condition, the screening element 16 is spaced from the wall 12 of the cavity by substantially 45 mm.

The cooking appliance 10 has an electrical insulation element 20. In the assembled condition, the electrical insulation element 20 is arranged in part between the induction heating element 14 and the wall 12 of the cavity. In the present exemplary embodiment, the electrical insulation element 20 is made largely from mica.

In the present exemplary embodiment, the electrical insulation element 20 has a thickness of substantially 0.3 mm. In the assembled condition, the induction heating element 14 is spaced from the wall 12 of the cavity by substantially 0.3 mm.

In the assembled condition, the electrical insulation element 20 directly adjoins the induction heating element 14. In the assembled condition, the electrical insulation element 20 directly adjoins the wall 12 of the cavity.

In the operating condition, the electrical insulation element 20 insulates the wall 12 of the cavity from a high-frequency alternating current flowing in the induction heating element 14. In the operating condition, the induction heating element 14 heats the wall 12 of the cavity inductively. In the operating condition, the induction heating element 14 heats the wall 12 of the cavity to a temperature of substantially 550° C.

LIST OF REFERENCE NUMERALS

10 Cooking appliance
12 Wall of the cavity
14 Induction heating element
16 Screening element
18 Thermal insulation element
20 Electrical insulation element
22 Cooker
24 Cavity
26 Cooking compartment
28 Cooker door
30 Cavity bottom wall
32 Cavity top wall
34 Cavity side wall
36 Cavity side wall
38 Cavity rear wall
40 Control unit
42 User interface

The invention claimed is:

1. A cooking appliance, in particular an induction oven appliance, comprising:
an induction heating element;
a substantially plate-like electrically conductive screening element configured to screen an electrical and/or magnetic field generated by the induction heating element; and
an electrical insulation element,
wherein the induction heating element is located between the electrically conductive screening element and the electrical insulation element, and
the cooking appliance is configured free of ferrites provided for conducting a magnetic field generated by the induction heating element.

2. The cooking appliance of claim 1, further comprising a cavity having a wall, said electrical insulation element being arranged on the wall of the cavity.

3. The cooking appliance of claim 1, further comprising a cavity having a wall, said screening element being arranged at least in part on a side of the induction heating element which side is remote from the wall of the cavity.

4. The cooking appliance of claim 1, wherein the screening element is made at least largely from aluminum and/or an aluminum alloy.

5. The cooking appliance of claim 1, further comprising a thermal insulation element arranged at least in part between the screening element and the induction heating element.

6. The cooking appliance of claim 5, wherein the thermal insulation element directly adjoins at least one of the screening element and the induction heating element.

7. The cooking appliance of claim 5, wherein the screening element is directly contacting the thermal insulation element, the thermal insulation element is directly contacting the induction heating element, and the induction heating element is directly contacting the electrical insulation element.

8. The cooking appliance of claim 1, further comprising a cavity having a wall, said induction heating element being spaced by at most 3 mm from the wall of the cavity.

9. The cooking appliance of claim 1, further comprising a cavity having a wall, said screening element being spaced from the wall of the cavity by at least 20 mm.

10. The cooking appliance of claim 1, further comprising a cavity having a wall, said induction heating element being configured to heat the wall of the cavity inductively.

11. The cooking appliance of claim 10, wherein in at least one operating condition, the induction heating element heats up the wall of the cavity to a temperature of at least 300° C.

12. The cooking appliance of claim 1, wherein the screening element is directly contacting the induction heating element, and the induction heating element is directly contacting the electrical insulation element.

13. A cooker, in particular an induction oven, comprising a cooking appliance, said cooking appliance comprising:
a cooking cavity having a wall;
an induction heating element;

a substantially plate-like electrically conductive screening element configured to screen an electrical and/or magnetic field generated by the induction heating element; and an electrical insulation element which is arranged at least in part between the induction heating element and the wall of the cavity wherein the cooker is configured free of ferrites provided for conducting a magnetic field generated by the induction heating element.

14. The cooker of claim 13, wherein said screening element is arranged at least in part on a side of the induction heating element which side is remote from the wall of the cavity.

15. The cooker of claim 13, wherein the screening element is made at least largely from aluminum and/or an aluminum alloy.

16. The cooker of claim 13, wherein the cooking appliance includes a thermal insulation element arranged at least in part between the screening element and the induction heating element.

17. The cooker of claim 16, wherein the thermal insulation element directly adjoins at least one of the screening element and the induction heating element.

18. The cooker of claim 16, wherein the screening element is directly contacting the thermal insulation element, the thermal insulation element is directly contacting the induction heating element, and the induction heating element is directly contacting the electrical insulation element.

19. The cooker of claim 13, wherein said induction heating element is spaced by at most 3 mm from the wall of the cavity.

20. The cooker of claim 13, wherein said screening element is spaced from the wall of the cavity by at least 20 mm.

21. The cooker of claim 13, wherein said induction heating element is configured to heat the wall of the cavity inductively.

22. The cooker of claim 21, wherein in at least one operating condition, the induction heating element heats up the wall of the cavity to a temperature of at least 300° C.

* * * * *